United States Patent [19]

Kato

[11] 4,435,086

[45] Mar. 6, 1984

[54] LIQUID CRYSTAL DISPLAY DEVICE FOR WORLD TIME WRISTWATCH

[75] Inventor: Yoshiaki Kato, Higashimurayama, Japan

[73] Assignee: Citizen Watch Company Limited, Tokyo, Japan

[21] Appl. No.: 283,985

[22] Filed: Jul. 16, 1981

Related U.S. Application Data

[63] Continuation-in-part of Ser. No. 22,496, Mar. 21, 1979, abandoned.

[30] Foreign Application Priority Data

Mar. 25, 1978 [JP] Japan ..... 53-034563

[51] Int. Cl.[3] ..... G04B 19/22

[52] U.S. Cl. ..... 368/22

[58] Field of Search ..... 368/21-24, 368/82, 223, 228, 242

[56] References Cited

U.S. PATENT DOCUMENTS

| | | | |
|---|---|---|---|
| 3,750,383 | 8/1973 | Karizawa | 368/242 |
| 3,822,545 | 7/1974 | Catto et al. | 368/22 |
| 3,940,920 | 3/1976 | Nakamura et al. | 368/22 |
| 3,973,388 | 8/1976 | Yoshida et al. | 368/242 |
| 4,044,545 | 8/1977 | Shimizu | 368/22 |

*Primary Examiner*—Vit W. Miska

*Attorney, Agent, or Firm*—Holman & Stern

[57] ABSTRACT

A liquid crystal display device for a world time electronic timepiece in which a display of world time is made by a liquid crystal display device, with various locations on a world map being selectable for display of local time, a corresponding marker on the world map being caused to flash to indicate selection and the name of the selected location being displayed in abbreviated form simultaneously with the local time at the selected location.

12 Claims, 7 Drawing Figures

LIQUID CRYSTAL DISPLAY DEVICE FOR WORLD TIME WRISTWATCH

This application is a continuation in part of a U.S. Pat. application Ser. No. 22,496 filed on Mar. 21, 1979 and now abandoned.

This invention relates to electronic timepieces providing a display of time at various locations or time zones throughout the world, and more particularly to an electro-optical display device for such a timepiece, which is highly suitable for an electronic wristwatch, and which provides a world map on which various locations throughout the world are indicated and whereby successive actuation of a switch enables any of said locations to be selected.

Various designs have been proposed for electronic timepieces which provide a display of the local time at various locations in the world, usually in conjunction with a map of the world which is an integral part of the timepiece. For brevity, we shall hereinafter refer to such timepieces as world timepieces. In one form of world timepiece, a panel is provided with a map of the world printed thereon, and several openings in the map corresponding to the locations of major cities throughout the world. Lamps are located within the openings. An electro-optical display device for displaying time in digital form, and a plurality of key switches are provided outside the area of the panel. Logic circuits are provided within the timepiece whereby, when a key switch is actuated, a corresponding lamp on the display panel lights, and the local time at the corresponding city is displayed on the electro-optical display device. Such a timepiece has the disadvantage that it is troublesome to search for the key switch corresponding to a particular location. Also, such a timepiece would be difficult to implement in a small size, as is required to construct an electronic wristwatch.

Another form of such a timepiece is of basically similar construction to the latter, but has a touch detection terminal placed adjacent to each of the display panel lamps of the world map. To designate selection of the local time at a particular location, the corresponding touch terminal need only be touched, whereupon the adjacent display panel lamp will light and the local time of the selected location is indicated in digital form. Such a timepiece has been disclosed in U.S. Pat. No. 3,940,920 issued on Mar. 2, 1976. Such a timepiece is convenient for use as a large-size clock. However, it is unsuitable for use as an electronic wristwatch, since it would be impractical to provide a plurality of touch switches in a very small size of world map, and sine the names of the locations to be selected, which must be provided on the world map itself, would become so small as to be unreadable.

An electronic wristwatch has been previously disclosed having a liquid crystal digital display section situated centrally, and having the names of about twenty major cities, each corresponding to a particular time zone, printed around the circumference of the liquid crystal display, in order of their time zone differences. Small markers, each corresponding to one of the city names, are provided at the periphery of the liquid crystal display, and one of these markers is made visible in order to indicate that the corresponding city has been selected for display of its local time. Selection of a particular city is performed by actuation of two pushbutton switches, which provide for clockwise and counter-clockwise rotation around the set of markers respectively. Another switch is provided whereby the local time of the time zone in which the timepiece is being utilized (referred to hereinafter as the home time) or the local time of a selected one of the cities indicated around the display periphery (referred to hereinafter as the local time) can be selectively displayed. Such a timepiece has the disadvantage that, since only the names of various cities, and not a world map, is displayed, it is difficult to find the local time at other locations in the world unless the timepiece user is aware that the desired location is in the same time zone as one of the cities indicated on the timepiece. Thus, one of the most attractive features of a world timepiece is missing in the latter type of electronic wristwatch.

It is therefore an object of the present invention to provide an electro-optical display device for an electronic timepiece having a world map in which a clear and easily readable world map display is incorporated.

Other objects, features and advantages of the present invention will be made more apparent from the following description, when taken in conjunction with the attached drawings, whose scope is given by the attached claims.

BRIEF DESCRIPTION OF DRAWINGS

Referring now to the diagrams, FIG. 1 is a general block diagram which is applicable to the various embodiments of the present invention which are described herein. Numeral 10 designates a plurality of externally actuated switches, which may be actuated by pushbuttons, a crown, or comprise touch-sensitive switches. Switch bounce suppression circuits, differentiator circuits, and memory circuits are also included in block 10. An output from block 10 is applied to a location specifying circuit 12, which is used to specify a particular location in the world, and may comprise a counter circuit. An output from location specifying circuit 12 is applied to a first decoder/driver circuit 14, which drives a location marker/location name section 16 of a liquid crystal display unit 15. The output from first decoder driver 14 to display section 16 causes the specified location to be indicated on display 15, by a marker appearing on a world map of display 15 and by characters indicating the name of the specified location being displayed.

Figure 1:
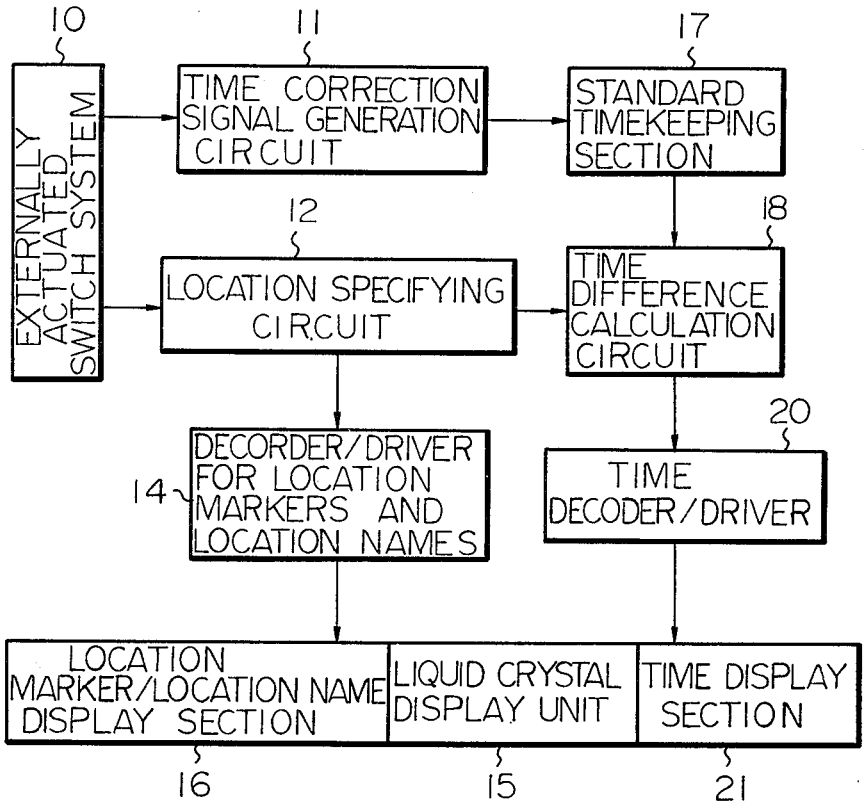
FIG. 1 is a block diagram of a display device according to the present invention.

Another output of switch system 10 is applied to a time correction signal generation circuit 11, which is thereby caused to produce a correction signal which is applied to a standard timekeeping section 17. Standard timekeeping section 17 produces standard time information, which can be corrected if necessary by the correction signal described above, and which is supplied to a time difference calculation circuit 18. Another output of location specifying circuit 12 is also applied to time difference calculation circuit 18, which thereby produces an output signal comprising time information which is advanced or retarded relative to the time information from standard timekeeping section 17 in accordance with the difference between the local time of the place in which the timepiece is being used and the local time of the specified location. This time information is applied through a time decoder/driver circuit 20 to a time display section 21 of electro-optical display unit 15, so that the local time at the specified location is displayed.

It should be noted that, with the arrangement of FIG. 1, correction of the home time (i.e. the local time of the place in which the timepiece is being utilized) will ensure that the correct local time will be displayed for any specified location in the world.

The switches in switch system 10 may comprise independent devices for each switching function, or may comprise a small number of devices which each perform a multiplicity of functions by being operated in combination. This can be achieved with known techniques for utilizing such switches.

Figure 2:
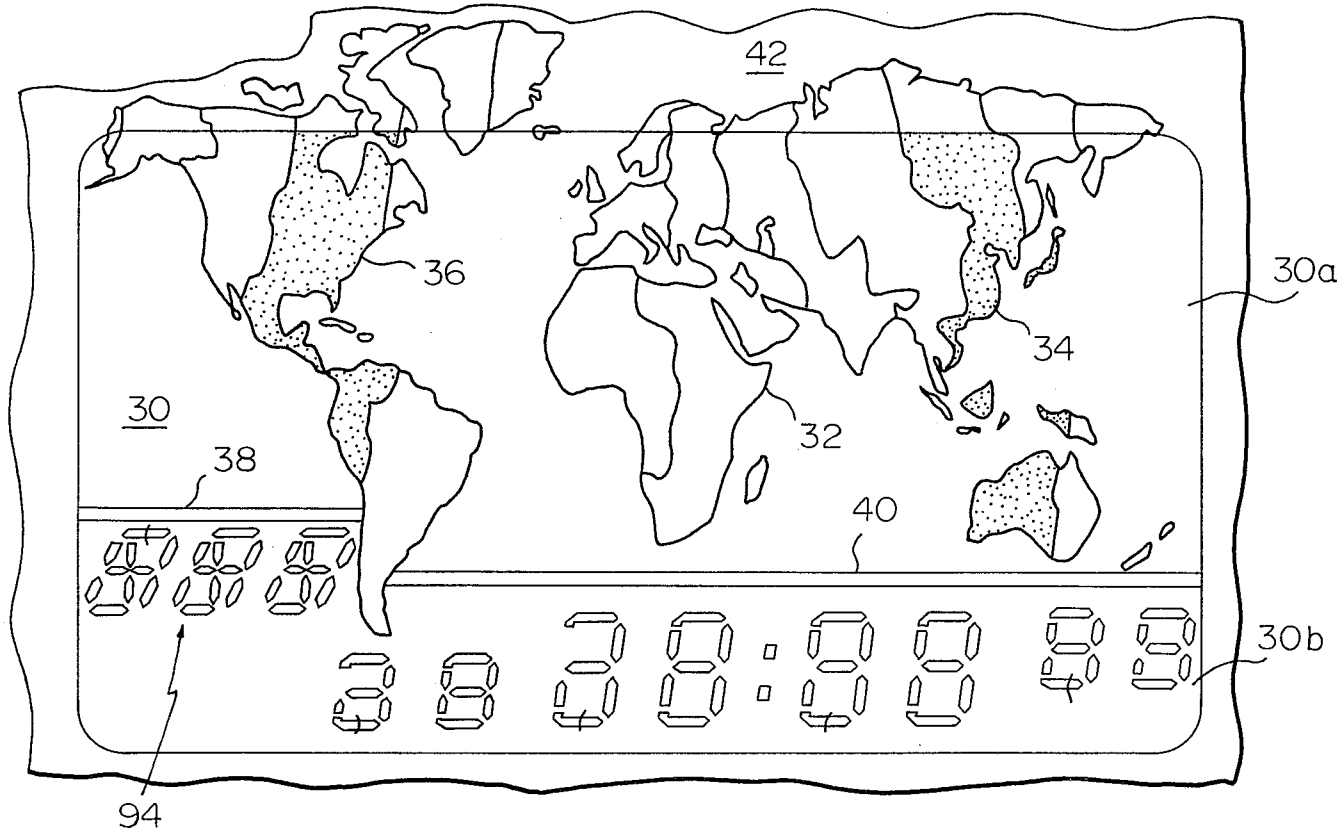
FIG. 2 is a plan view of a map section of the display device according to the present invention.

Referring now to FIG. 2, a map portion of a timepiece display in accordance with a preferred embodiment of the present invention is shown therein. Numeral 30 denotes a liquid crystal display on which portions of a world map and various time and date location are displayed. For clarity of the following description, only the world map portion of the display is shown in FIG. 2. The liquid crystal display 30 comprises a world map display section 30*a* and a time indicating section 30*b*, which is out of overlapping relationship relative to the world map display section. The continents appearing on this map are divided into time zones, with a fixed time difference between adjacent time zones. The name of a location which has been selected for display of its local time is indicated by letters appearing in a part of the display below the world map. In this embodiment, a total of twelve time zones are indicated with a view to providing easiness of looking the display of the wristwatch, with the width of each zone representing two hours of time difference. The time zones may be provided in equal to or greater than 24, i.e., the number of time differences. However, it is also possible to vary the width of each zone so that all of the zones contain the same number of locations which can be selected for display of local time.

Numeral 32 denotes the fixed outline of a world map, which is provided by printing or other means. Individual zones are provided by time zone indicating segment electrodes of the liquid crystal display, which have outlines that match those of the world map 32. These segment electrodes can be selectively activated to cause one or more of the time zones to appear in contrast to the remainder of the display area. In FIG. 2, it is assumed that the home location is Japan, so that the time zone 34 corresponding to Japan is turned on (i.e. made visible) and that the local zone 36 that has been selected is that which covers the eastern United States and parts of South America as well as Central America.

In order to make the world map as large as possible, to facilitate observation, the map is extended beyond the periphery of the liquid crystal cell display area. This can be done by printing an additional part of the map (denoted by numeral 42) on a display masking plate, by providing a transparent plate having the map printed thereon between the liquid crystal display cell together with its masking plate and the glass dial plate of the timepiece. The world map can also be formed upon the watch glass itself, preferably on its inner surface.

To provide a clear separation between the world map and the lower portion of the display, which contains time and other digital information, two dividing lines 38 and 40 provided on liquid crystal display 30, by means to be described hereinafter.

It should be noted that it is also possible to indicate the local zone and home zone in other ways that described above.

There are various modes of operation whereby the home zone, local zone, and other areas can be distinguished from one another. For example, it can be arranged that the home zone (and/or the local zone) flashes on and off repetitively while the other zones are held in the on (i.e. visible) state. Or it can be arranged that the home (and/or local zone) is held in the off (i.e. non-visible) state, while all other zones are held in the on state. It is also possible to arrange that the home zone (and/or local zone) is held in the on state while all other zones flash on and off repetitively. Or the home and local zone land areas can be displayed in a different color to the remaining land areas, if a color liquid crystal material is used. If such a method is adopted, then it may be possible to dispense with the fixed world map.

Figure 3:
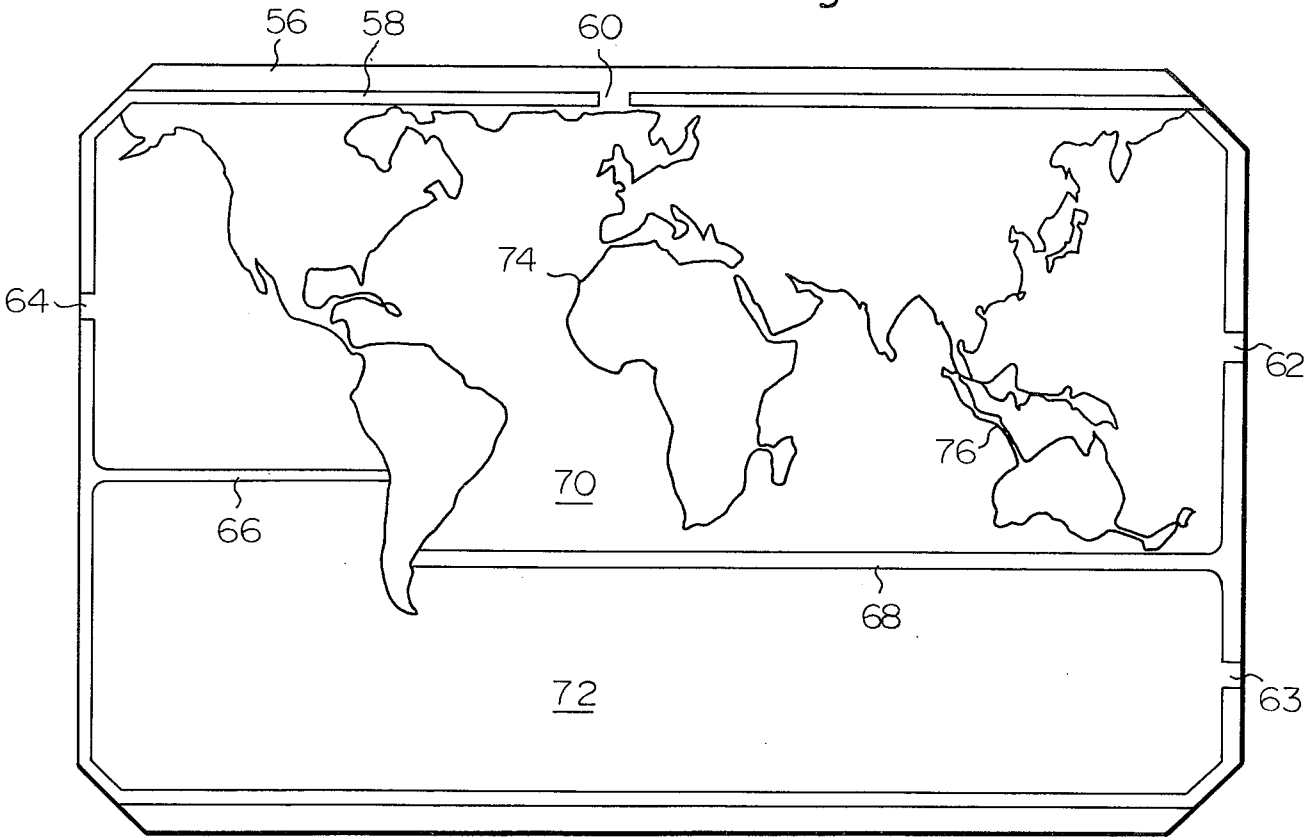
FIG. 3 is a view of the inner face of an upper glass substrate of the display device of FIG. 2.

FIG. 3 shows an upper glass substrate 256 for the display of FIG. 2, as seen from the lower side. It should be noted that the lateral relationship are actually reversed in FIG. 3, for ease of description. Numeral 58 denotes a sealing member, which is used to seal a layer of liquid crystal between substrate 56 and a lower glass substrate. Numeral 74 denotes a partition member, made of the sealing material, which forms the outline of the world map, and which is of sufficient thickness (above the substrate plane) to reach the inner surface of the lower substrate when the liquid crystal cell is assembled, and adheres thereto. In this way, enclosed chambers are formed, which correspond to the land areas of the world and the sea areas. Similarly, dividing lines of sealing member 66 and 68 form a separate chamber in the lower part of the liquid crystal cell. This arrangement enables liquid crystal material of different types to be provided in the continental land areas, the sea areas, and the digital information display area. These liquid crystal materials can provide different colors, molecular orientation, contrast, etc. In this way, novel display effects can be obtained, which add to the commercial appeal of such a timepiece. To provide continuity of these chambers for the land areas, passages 76 are provided between islands and the major continental areas. It should be noted that the present invention may also be applicable to a liquid crystal display cell with a single chamber in which a liquid crystal material is filled.

Figure 4:
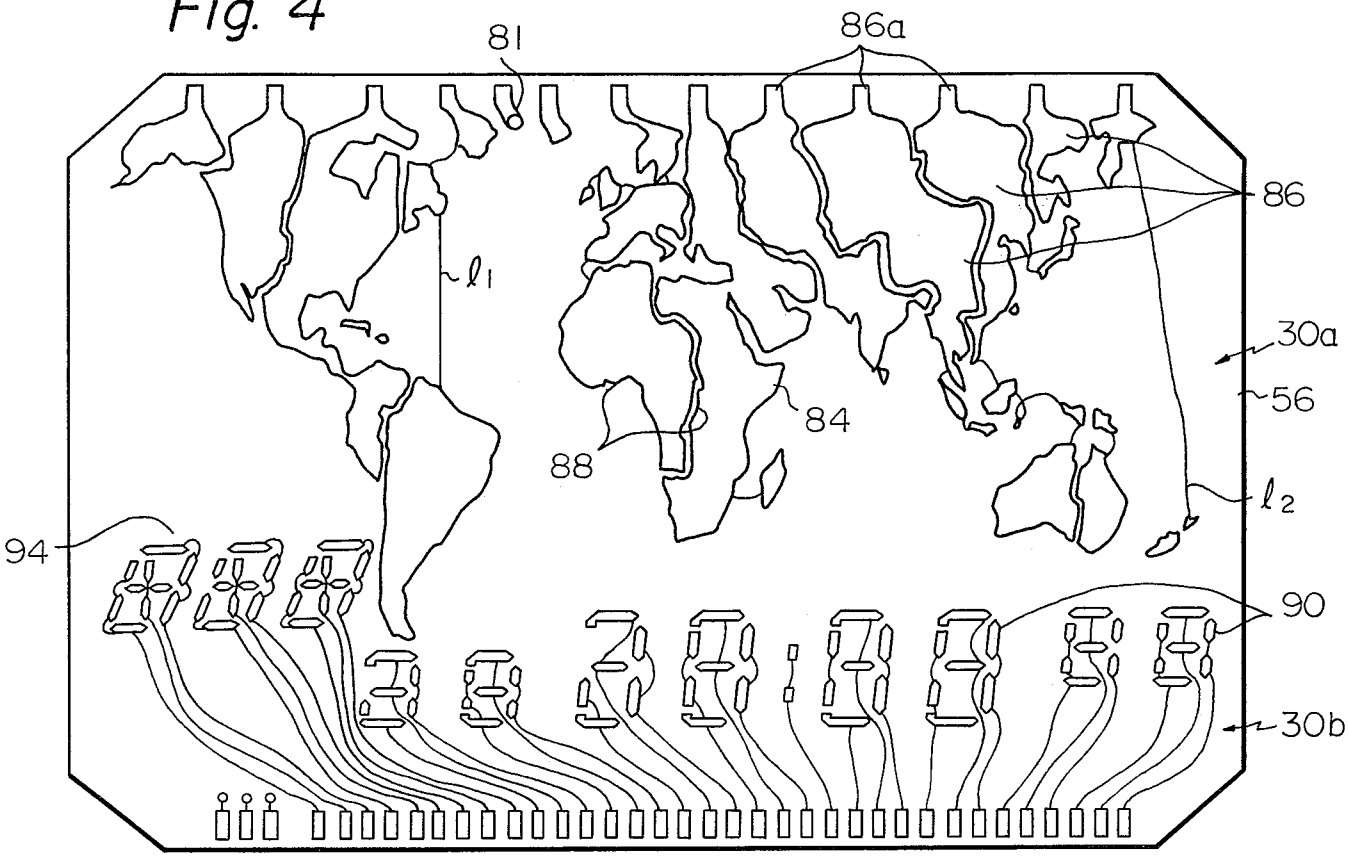
FIG. 4 is a view of the inner face of the upper glass substrate showing a plurality of segment electrodes.
Figure 6:
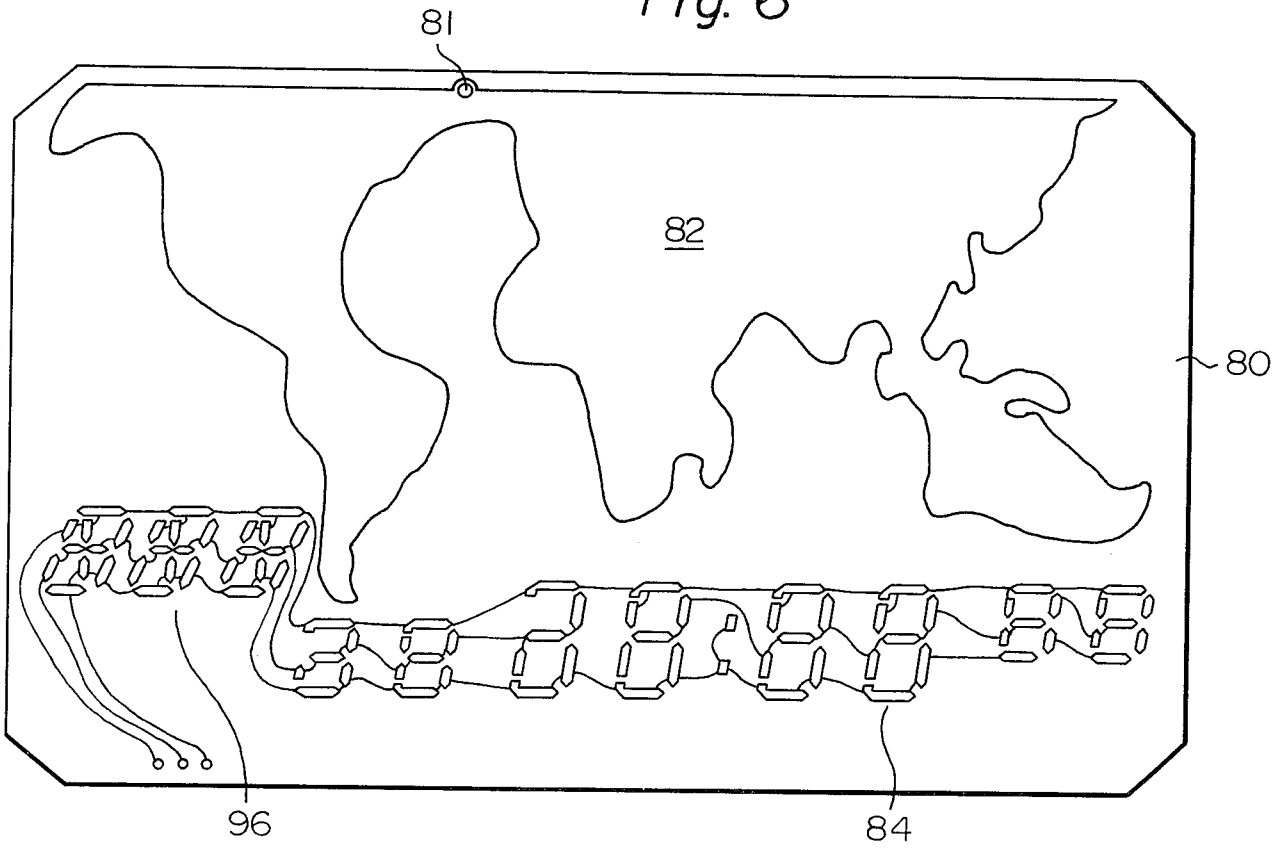
FIG. 6 is a view of the inner surface of the lower glass substrate forming part of the display device of FIG. 2.

FIG. 4 shows the segment electrode pattern formed on the lower surface of upper substrate 56. As in the case of FIG. 3, the actual lateral relationships are inverted in this drawing for ease of description, since the substrate is viewed from the lower side. Digit electrodes for the map portion of this embodiment can comprise a single conducting plane 82 on the lower substrate 80 (see FIG. 6) of the liquid crystal cell, facing the segment electrodes of the map, or by making part of the lower substrate a solid conductor 81.

Figure 5:
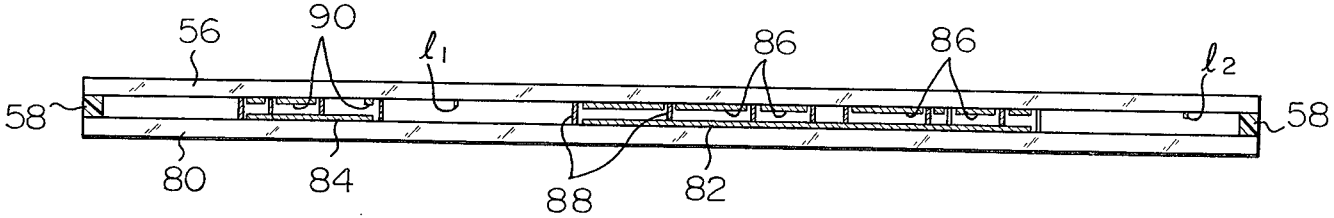
FIG. 5 is a cross section of the display device shown in FIG. 2.

As shown in FIG. 4, a plurality of time zone indicating segment electrodes 86 are formed on an inner surface of the upper glass substrate 56 in such a manner that the plurality of time zone indicating segment electrodes provide a shape of a world map. Each of the plurality of time zone indicating segment electrodes has an external electrode terminal 86a to selectively turn on and off each of the plurality of time zone indicating segment electrodes 86. The world map has a plurality of land boundaries which are defined by outline patterns including a sealing member 88 (see FIGS. 4 and 5). The sealing member 88 is formed on one of the inner surfaces of the upper and lower glass substrates by a printing technique. The time indicating section 30b comprises a plurality of time indicating segment electrodes 90 formed on the inner surface of the upper glass substrate 56 (see FIG. 4). and a common electrode 84 formed on the inner surface of the lower glass substrate 80 (see FIG. 5). The common electrode 84 faces the plurality of segment electrodes 90.

With the arrangement mentioned above, a turning on or turning off state of selected one of said plurality of time zone indicating segment electrodes is rendered to be different from that of other remaining time zone indicating segment electrodes and, at the same time, the time display section serves to display a current time of a location corresponding to a selected time zone.

Turning now to FIG. 2, the display device further comprises a location display section 94 composed of three alphabetic letters indicating segment electrodes and a common electrode 96 (see FIG. 6) facing thereto. The location display section displaying the name of the selected location whose current time is displayed by the time display section 30b.

Figure 7:
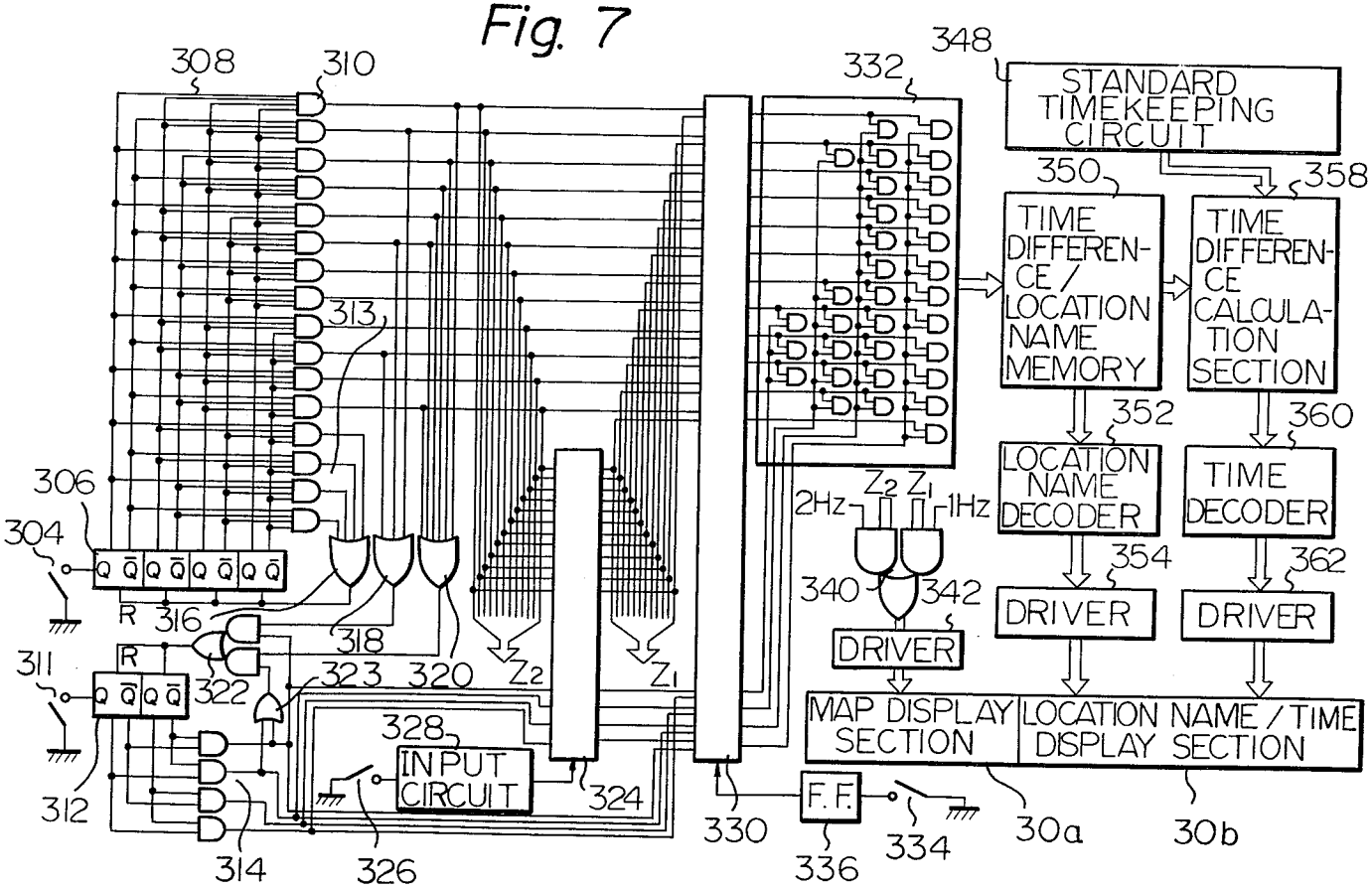
FIG. 7 is a detailed circuit of FIG. 1.

Referring now to FIG. 7, a diagram is shown therein of the circuitry for the display cell shown in FIG. 2. Numeral 304 denotes a zone selection switch, which is coupled to an input terminal of a counter circuit 306. Selection of time zones is performed by successive actuations of switch 304, which are counted by counter 306. For clarity of description, the input circuits required for switch bounce suppression are not shown in FIG. 7. Combinations 308 of the outputs of counter 306 are applied to AND gates 310 to be decoded. One of AND gates 310 outputs goes to the high logic level for each count state of counter 306. 16 outputs are provided from AND gates 310, but four of these outputs, indicated by numeral 310, are fed back to reset terminals of counter 306, making this a scale-of-12 counter.

Numeral 311 denotes a switch which is used to select a particular location within a time zone. The number of actuations of switch 311 are counted by a 2-stage counter 312, outputs of which are applied to a set of AND gates 314. The number of locations within a time zone can vary, but for this embodiment, the number of locations is in the range 2 to 4. The count scale of counter 312 is therefore modified in accordance with the particular time zone. This is done by means of combinations of outputs of AND gates 310 applied through OR gates 318 and 320, and through gate circuit 322, in conjunction with outputs from AND gates 314 fed back through gate 323 to the reset terminals of counter 312.

The outputs of AND gates 310 are applied to a memory circuit 324, while the outputs of this memory circuit together with the direct outputs from AND gates 310 are selectively applied through changeover circuit 330 to a location specifying matrix 332. The outputs of AND gates 314 are also applied directly to changeover circuit 330 and to memory circuit 324. Thus, location and time zone information can be selectively applied to a location/zone specifying matrix 332 by means of changeover circuit 330, in response to successive actuations of switch 334. The home location information is stored in memory 324, i.e. the high logic level state of one of AND gates 310 which corresponds to the home time zone and of one of AND gates 314 which corresponds to the home location, are stored in memory 324. Thus, by actuating switch 334, either the home information from memory 324 or local information applied directly from AND gates 310 and 314 can be input to location/zone specifying matrix 322.

Information from AND gates 310 and memory 324 which indicates the home and local time zones is output as indicated by $Z_2$ and $Z_1$, and is applied through a set of gates 340 to display driver circuit 342. Signals $Z_1$ and $Z_2$ are modulated at frequencies of 1 Hz and 2 Hz, so that flashing on and off of the corresponding time zones at these frequencies occurs on the display. In this way, the home time zone and local time zone can be easily identified. The outputs of display driver 342 is applied to map display section 30a of the timepiece liquid crystal display.

Other information from location specifying matrix 322 is applied to a location name/time difference memory 350. Location name information from memory 350 is applied to a location name decoder 352, the output of which is applied through display driver 354 to location name and time display section 30b of the timepiece liquid crystal display. Time difference information is applied from memory 350 to a time difference calculation section 358, and is combined therein with standard time information supplied from a standard timekeeping circuit 348. After the required time difference has been added to or subtracted from the standard time, the resultant information is applied to a time decoder 360 which produces numeric segment information. The output of time decoder 360 is applied through a display driver 362 to the location name and time display area of the timepiece display.

Locations such as cities may be indicated on the map display portion of the display by means of fixed markers. It may also be possible to arrange that the home time zone and the selected local time zone are turned off on the map display, while only the remaining time zones are turned on (i.e. made visible).

Counter 306 can be made of bidirectional type, so that shifting of time zones from east to west or from west to east can easily be performed by actuation of switch 304. For effective presentation when the timepiece is placed on window display for sale, means can be provided whereby a particular mode of actuation of the timepiece switches causes counter 306 to become free-running, so that the various time zones are repetitively displayed.

Switches 304 and 311 can also be replaced by a single dual-function switch. Alternatively, switches 304 and 311 can comprise switches which are coupled to a timepiece crown, and are selectively actuated in accordance with the direction of rotation of the crown.

It is also possible to provide a separate push-button switch or touch-sensitive switch for each of the time zones, together with a lock switch to disenable these time zone switches.

This circuit example may also be modified such that a suitable marker, representing the sun, an aircraft, or an artificial sattelite for example, is caused to move across the world map to indicate the various time zones. It is also possible to utilize a liquid crystal display cell having two layers of liquid crystal material arranged to overlap each other, with one of the layers providing the world map display and the other layer being used to provide time and other digital information such as location names. This enables the limited display area of a wristwatch to be effectively utilized, and enhances the display visibility. Ease of reading the display can be enhanced by causing the two different display layers to produce patterns in different tones from each other. If this method is utilized, the time and location information displays should be positioned in areas of the world map where there is a low concentration of cities.

It will now be appreciated from the foregoing description that in accordance with the present invention since a world map is incorporated in a liquid crystal display device in which an upper glass substrate has a plurality of time zone indicating segment electrodes providing a world map and a lower glass substrate is provided with a common electrode having a shape corresponding to the world map, the structure of the world map display device is minimized to be suited for an electronic wristwatch.

What is claimed is:

1. A liquid crystal display device for a world time display electronic wristwatch, comprising:

an upper glass substrate;

a plurality of time zone indicating segment electrodes formed on an inner surface of said upper glass substrate in such a manner that said plurality of time zone indicating segment electrodes provide a shape of a world map, each of said plurality of time zone indicating segment electrodes having an external electrode terminal to selectively turn on and off said each of said plurality of time zone indicating segment electrodes;

a lower glass substrate spaced from said upper glass substrate;

a common electrode formed on an inner surface of said lower glass substrate and having a shape corresponding to said world map, said common electrode facing said plurality of time zone indicating segment electrodes; and a sealing member disposed between said upper and lower glass substrates to provide a hermetic sealing;

a liquid crystal material disposed in a space between said upper and lower glass substrate, by a partition member made of a sealing material;

a time display section; and a location display section composed of a plurality of alphabetic letters indicating segment electrodes and a common electrode facing thereto, said location display section displaying the name of said selected location whose current time is displayed by said time display section.

2. A liquid crystal display device according to claim 1, in which said world map has a plurality of land boundaries which are defined by outline patterns including a sealing member and formed on one of the inner surfaces of said upper and lower substrates by a printing technique.

3. A liquid crystal display device according to claim 1 or 2 further comprising a world map display section, said plurality of time zone indicating segment electrodes being located in said world map display section, and said world map display section and said time display section being out of overlapping relationship.

4. A liquid crystal display device according to claim 3, in which said time display section comprises a plurality of time indicating segment electrodes formed on the upper glass substrate, and a common electrode formed on the inner surface of said lower glass substrate and facing said plurality of time indicating segment electrodes, and in which a turning on or turning off state of a selected one of said plurality of time zone indicating segment electrodes is rendered to be different from that of other remaining time zone indicating segment electrodes and, at the same time, said time display section serves to display a current time of a location corresponding to a selected time zone.

5. A liquid crystal display device according to claim 4, further comprising a location display section composed of a plurality of alphabetic letters indicating segment electrodes and a common electrode facing thereto, said location display section displaying the name of said selected location whose current time is displayed by said time display section.

6. A liquid crystal display device according to claim 1, in which the number of said alphabetic letters is three.

7. A liquid crystal display device for a world time display electronic wristwatch, having first, second and third display areas therein, comprising:

upper and lower substrates spaced from one another by means of spacer means to provide a space;

a liquid crystal material disposed in the space between said upper and lower substrates;

a world map display section disposed in said first display area;

a location display section disposed in said second display area, in substantially out of overlapping relationship with respect to said first display area, for providing a display of a plurality of alphabetic letters representing the name of one of said predetermined locations; and a time display section disposed in said third display area, in substantially out of overlapping relationship with respect to said first and second display areas, to provide a display of current time at said one of said predetermined locations;

said world map display section including a plurality of sets of segment electrodes corresponding to time zones, respectively, each of said segment electrodes being formed on an inner surface of said upper substrate and having a shape and position corresponding to part of the boundary of one of said time zones in which said one of said segment electrodes is drivable to differently provide a display of said one of said time zones, and a common electrode formed on an inner surface of said lower substrate, said plurality of sets of segment electrodes having a shape to correspond to a world map, and said common electrode having a shape corresponding to the world map and cooperating with said plurality of sets of segment electrodes to provide a display of the world map.

8. A liquid crystal display device according to claim 7, in which said world map display section comprises a world map whose land boundaries are defined by a fixed outline pattern formed between said upper substrate and said lower substrate, said fixed outline pattern including a sealing material formed on the inner surface of one of said upper and lower substrates by a printing technique.

9. A liquid crystal display device according to claim 7, in which the total number of said plurality of time zones is twelve.

10. A liquid crystal display device according to claim 7, in which a masking plate is provided above a portion of said liquid crystal display device, and wherein a part of said fixed outline pattern defining land boundaries of said world map section is formed upon said masking plate by a printing technique.

11. A liquid crystal display device according to claim 7, in which said location display section comprises an abbreviation display section composed of three alphabetic letters representing abbreviation of the name of one of said predetermined locations.

12. A liquid crystal display device according to claim 7, in which a plurality of liquid crystal materials having different properties are enclosed in chambers formed by a partition member made of a sealing material between inner faces of said upper and lower substrates, said partition member being of sufficient height to exclude a layer of said liquid crystal material from forming between said partition member and said upper and lower substrates.

* * * * *